US012774645B2

(12) United States Patent
Billingham

(10) Patent No.: US 12,774,645 B2
(45) Date of Patent: Oct. 27, 2026

(54) SEGMENTED EXPANDING GUN FOR PLUG AND ABANDONMENT APPLICATIONS

(71) Applicant: SCHLUMBERGER TECHNOLOGY CORPORATION, Sugar Land, TX (US)

(72) Inventor: Matthew Edward Billingham, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/139,343

(22) PCT Filed: Dec. 27, 2023

(86) PCT No.: PCT/US2023/085992
§ 371 (c)(1),
(2) Date: Jun. 15, 2025

(87) PCT Pub. No.: WO2024/145333
PCT Pub. Date: Jul. 4, 2024

(65) Prior Publication Data

US 2026/0201763 A1 Jul. 16, 2026

Related U.S. Application Data

(60) Provisional application No. 63/477,570, filed on Dec. 29, 2022.

(51) Int. Cl.

| | |
|---|---|
| ***E21B 29/08*** | (2006.01) |
| ***E21B 29/02*** | (2006.01) |
| ***E21B 43/117*** | (2006.01) |

(52) U.S. Cl.
CPC ..... *E21B 29/08* (2013.01); *E21B 29/02* (2013.01); *E21B 43/117* (2013.01)

(58) Field of Classification Search
CPC ..... E21B 29/08; E21B 29/02; E21B 43/117
See application file for complete search history.

(56) References Cited

U.S. PATENT DOCUMENTS

| | | | | |
|---|---|---|---|---|
| 3,415,321 | A | 12/1968 | Venghiattis | |
| 4,739,839 | A * | 4/1988 | Regalbuto | E21B 43/117 175/4.6 |
| 5,777,257 | A * | 7/1998 | Kenny | F42B 1/028 102/307 |
| 5,816,747 | A | 10/1998 | Welch | |
| 6,805,056 | B1 * | 10/2004 | Poe | E02B 17/00 102/341 |
| 2003/0089498 | A1 * | 5/2003 | Johnson | E21B 37/08 166/55 |
| 2004/0108114 | A1 * | 6/2004 | Lerche | E21B 47/12 166/302 |
| 2009/0078402 | A1 | 3/2009 | Fuhst | |

(Continued)

*Primary Examiner* — Steven A Macdonald
(74) *Attorney, Agent, or Firm* — Jeffrey D. Frantz

(57) ABSTRACT

Systems and methods presented herein provide for a segmented expanding gun for plug and abandon downhole applications. The expanding gun can include a first ring of multiple shaped charges. First and second charges in the ring can be identically shaped and contiguous. The first ring expands radially to deploy the shaped charges on a tubular wall. Multiple rings can be stacked and offset axially.

18 Claims, 8 Drawing Sheets

(56) References Cited

U.S. PATENT DOCUMENTS

| | | | | |
|---|---|---|---|---|
| 2010/0012312 | A1* | 1/2010 | Ochoa | E21B 43/117 166/55.8 |
| 2012/0067578 | A1* | 3/2012 | Wood | E21B 29/02 166/299 |
| 2013/0192829 | A1* | 8/2013 | Fadul | E21B 43/11 166/297 |
| 2014/0034384 | A1* | 2/2014 | Fadul | E21B 43/116 175/2 |
| 2015/0096752 | A1* | 4/2015 | Burgos | E21B 47/12 166/297 |
| 2015/0361774 | A1* | 12/2015 | Flores | F42B 1/028 166/297 |
| 2017/0114622 | A1* | 4/2017 | Umphries | E21B 43/119 |
| 2017/0159397 | A1* | 6/2017 | Tolman | E21B 33/1208 |
| 2018/0087352 | A1* | 3/2018 | Greenway | E21B 43/117 |
| 2018/0291697 | A1* | 10/2018 | Oag | E21B 29/02 |
| 2019/0271214 | A1* | 9/2019 | Robey | E21B 43/117 |
| 2019/0368320 | A1* | 12/2019 | Robey | E21B 17/1014 |
| 2020/0141213 | A1 | 5/2020 | Collier | |
| 2020/0224518 | A1* | 7/2020 | Trefilov | F42D 3/04 |
| 2021/0131236 | A1* | 5/2021 | MacGillivray | E21B 43/117 |

* cited by examiner

SEGMENTED EXPANDING GUN FOR PLUG AND ABANDONMENT APPLICATIONS

CROSS-REFERENCE TO RELATED APPLICATIONS

The present application is a National Stage Entry of International Application No. PCT/US2023/085992, filed Dec. 27, 2023, which claims priority benefit of U.S. Provisional Application No. 63/477,570, filed Dec. 29, 2022, the entirety of which is incorporated by reference herein and should be considered part of this specification.

BACKGROUND

Downhole mechanical service tools allow for performing operations within a wellbore. When it is time to decommission the well, casing and tubular elements might remain present in the wellbore. It may be difficult or even impossible to remove the casing and tubular elements as part of the decommissioning.

Perforating charges and mechanical cutters today are typically conveyed in the wellbore on either slickline, wireline, or coiled tubing. Although today live depth control has become common practice in well interventions, limited control is available for the positioning of a gunstring or mechanical tool within the primary tubular element that the toolstring is conveyed in.

As a result, the ability for the charges or mechanical cutter to create the necessary flow area (e.g., tunnel or slot) is impacted by the lack of control and precision of the toolstring. This might result in an ineffective conduit for fluid. This can also potentially lead to the destruction of other elements present in the construction of the well (e.g., another casing or jewelry element). Such other elements may be inadvertently cut as a consequence of the improper placement of the perforating charge or the mechanical cutter. Conversely, the inability to control the positioning of the bottomhole assembly may prevent the successful cut of specific parts of the wellbore in a surgical manner (e.g., selectively severing the control lines behind a tubing without entirely cutting the tubing in a full 360-degree cut).

To advance the application of well decommissioning, new ways are needed to cut control lines outside of an oilwell tubing string.

SUMMARY

Systems and methods are described herein for a segmented radial cutter. The segmented radial cutter can be expanded on demand to cut control lines outside of an oilwell tubing string. A radial opening mechanism can include a cutter made of individual encapsulated shaped charges. When in a non-expanded state, the radial opening mechanism can be run through wellbore restrictions.

In one example, individual encapsulated shaped charges can be assembled into a ring to form a cutting plane. For example, a shaped charge can be shaped such that multiple contiguous shaped charges form a ring. The ring of shaped charges can have a cylindrical interior space to accept an opening mechanism.

When on depth, an opening mechanism can radially expand the ring. The opening mechanism can be one or more cylinders. Expanding the ring can deploy the shaped charges to the inside diameter of the tubular. This can eliminate radial charge clearance and eliminate a high and low side for the cutting process.

When the charges are deployed, there can be a gap between consecutive charges at the same axial level. For example, the gap can form between consecutive shaped charges as they are pushed outward during ring expansion. Additional layers of shaped charges can be deployed. These additional layers can be offset from other layers to ensure a full 360 cut coverage but not a continuous 360 single cut that would sever the tubing. Any desired number of layers of shaped charges can be combined and can be offset vertically for the job requirements. For example, one set can be two feet apart from another set of shaped charges. These sets can be referred to as cutter assemblies. The individual cutter assemblies can be fired separately by use of addressable switch technology or other selective methods.

Some shaped charges may be run as dummy charges to prevent a full ring of cuts. Rather than cut 360 degrees around the pipe (as a discontinuous series of cuts), the "live" shaped charges may be orientated towards the control line(s) location actively or passively when the control line location outside the tubing has been determined. The dummy charges will not cut the pipe, whereas the live charge(s) can cut through to the control line. A cutter segment can jet cut a control line in this manner.

It is to be understood that both the foregoing general description and the following detailed description are exemplary and explanatory only and are not restrictive of the embodiments, as claimed.

BRIEF DESCRIPTION OF THE DRAWINGS

The accompanying drawings, which are incorporated in and constitute a part of this disclosure, illustrate various embodiments and aspects of the present invention. In the drawings.

DESCRIPTION OF THE EXAMPLES

Reference will now be made in detail to the present exemplary examples, including examples illustrated in the accompanying drawings. Wherever possible, the same reference numbers will be used throughout the drawings to refer to the same or like parts. The described examples are non-limiting.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Generally, tools, systems, and methods are provided for plugging and abandoning a wellbore. The cutting tool can include one or more rings of shaped charges. The shaped charges can fit together to form the ring in a closed state. Then the ring can expand, with the charges pressing outward radially. The expanded ring can press the charges against a tubular wall. The charges can then be deployed.

The open hole perforating system of the present invention can be used to remove a control line, downhole tubulars, or to address any hydrocarbon bearing formations with any lithology. In some examples of the present invention, an openhole wellbore may be perforated to remove filtercake in an underbalanced, overbalanced, or near-balanced well environment. Systems and methods presented herein provide for a cutting tool for use in well decommissioning.

Figure 1:
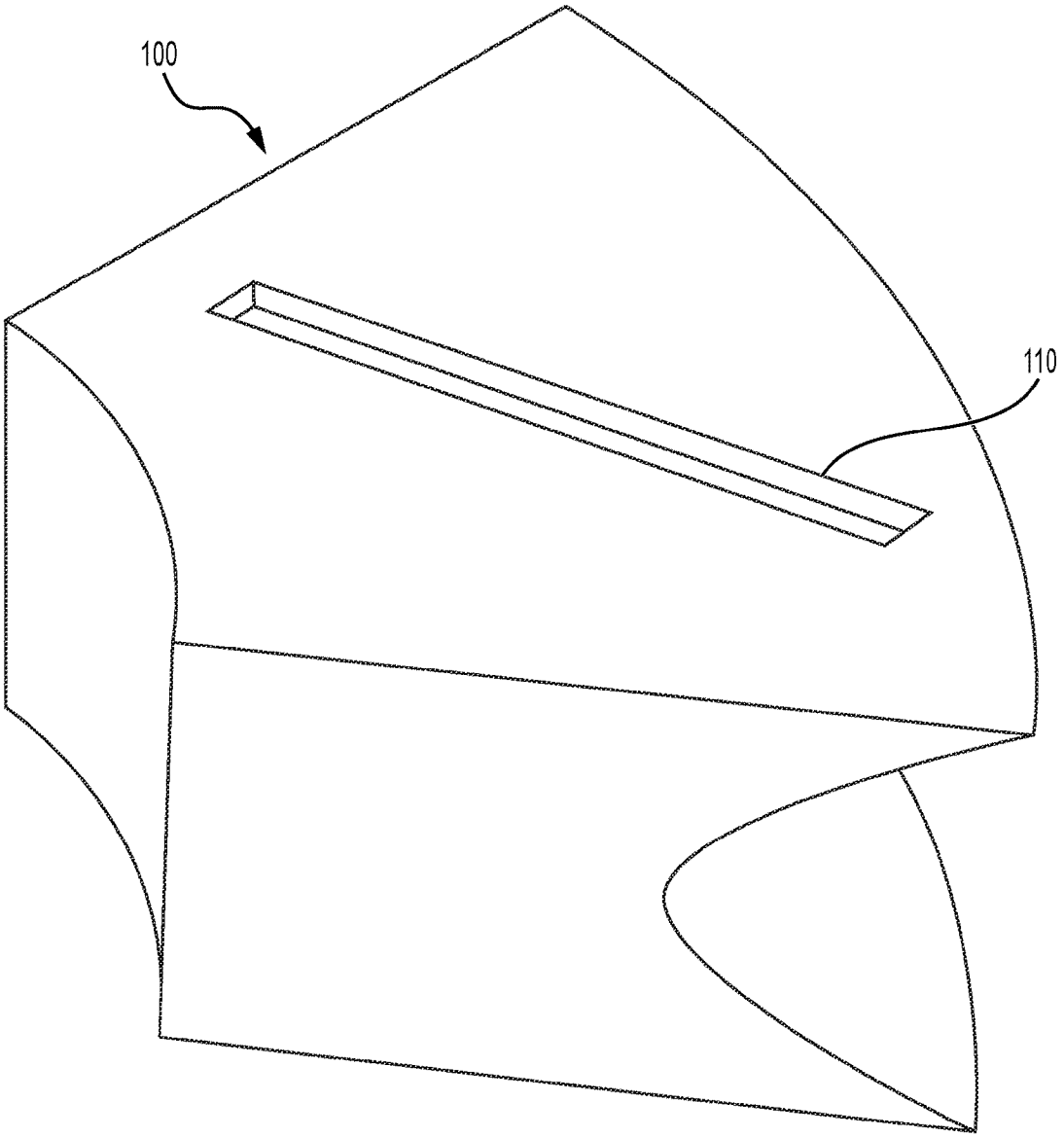
FIG. 1 is an example illustration of a perspective view of a shaped charge.

FIG. 1 is an example illustration of a perspective view of an individual encapsulated shaped charge 100. The shaped charge 100 can be an explosive device designed to direct the explosive force in a particular direction. Several of these charges 100 can be assembled into a ring to form a cutting plane. Each shaped charge can include a guidance groove 110. The guidance groove 110 can mate with a pin, allowing the shaped charge to move outward on a predictable path. The guidance groove 110 is designed to mate with a pin, facilitating a controlled and predictable outward movement of the shaped charge 100 along a specific path. This mechanism provides a level of precision and control in the deployment of the shaped charges, allowing for a directed and targeted application of explosive force.

Figure 2:
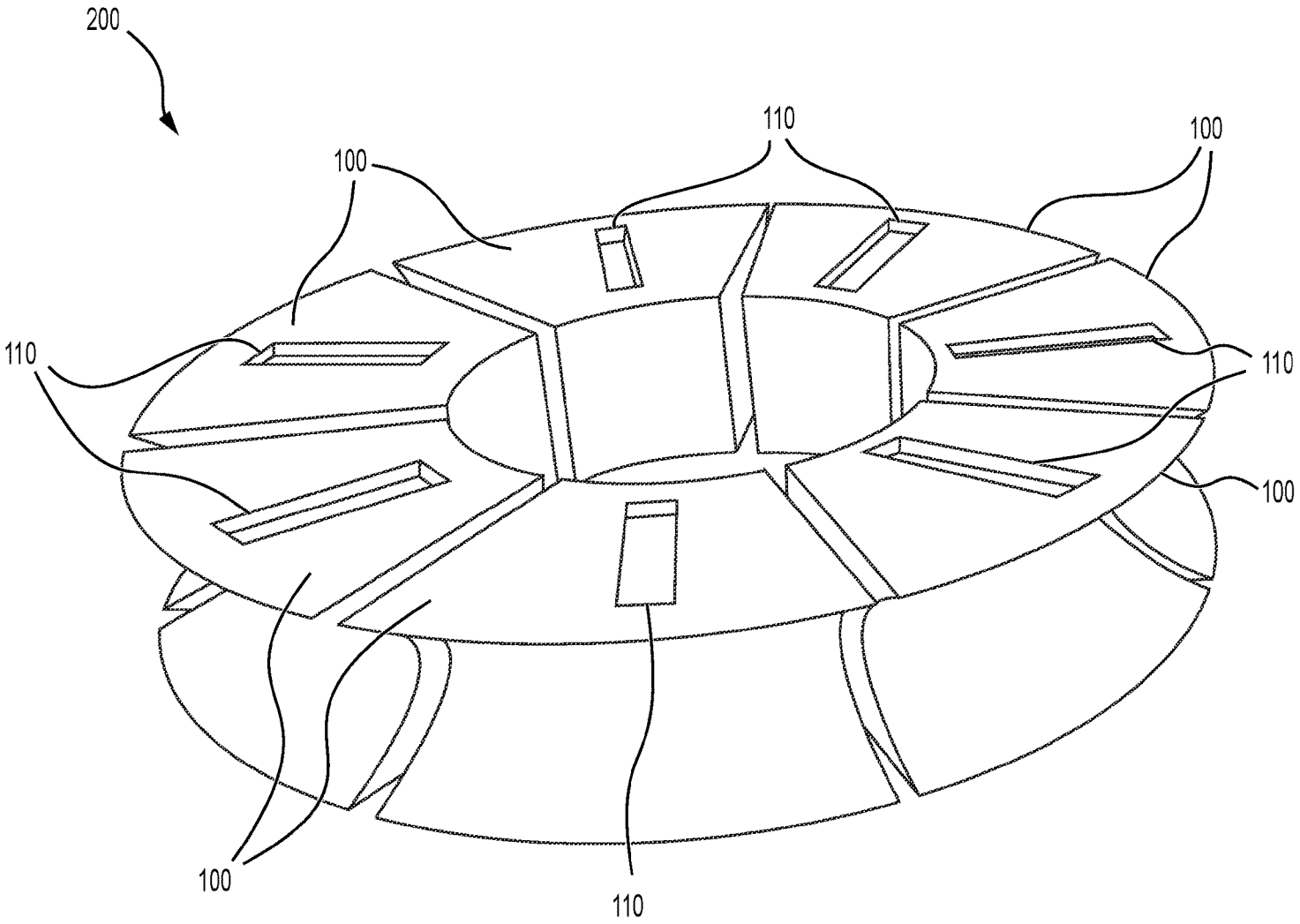
FIG. 2 is an example illustration of a perspective view of a ring of shaped charges.

FIG. 2 is an example illustration of a perspective view of a cutter ring 200 of shaped charges 100. In this example, seven shaped charges 100 form the cutter ring 200. The ring is in a closed state. The shaped charges 100 in the cutter ring 200 collectively contribute to cutting operations.

Figure 3B:
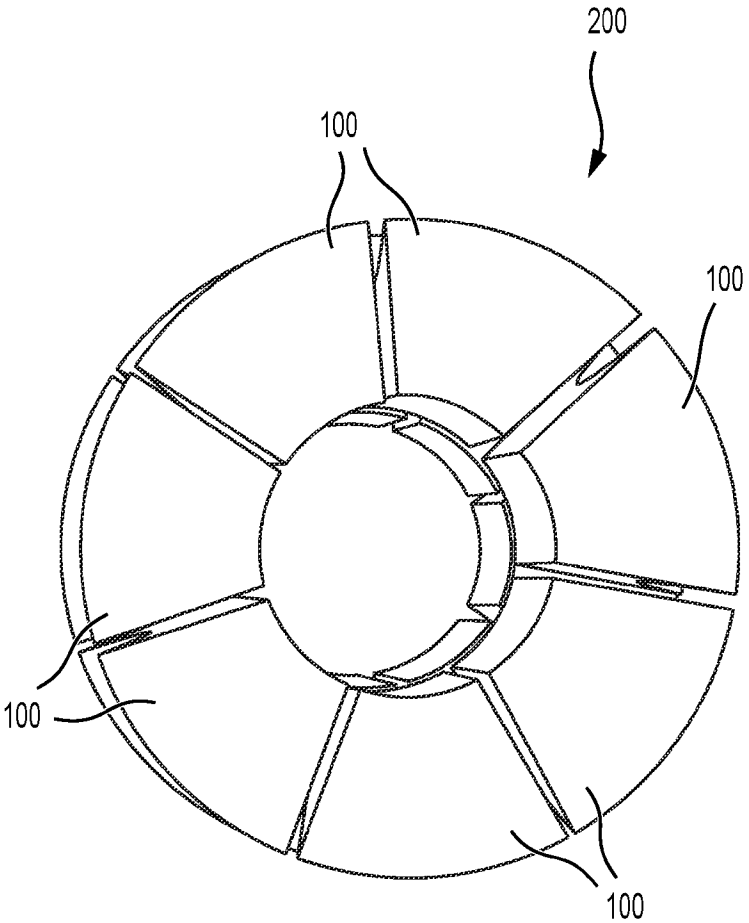
FIG. 3B is an example illustration of a top-down perspective view of a cutter in a closed state.
Figure 3A:
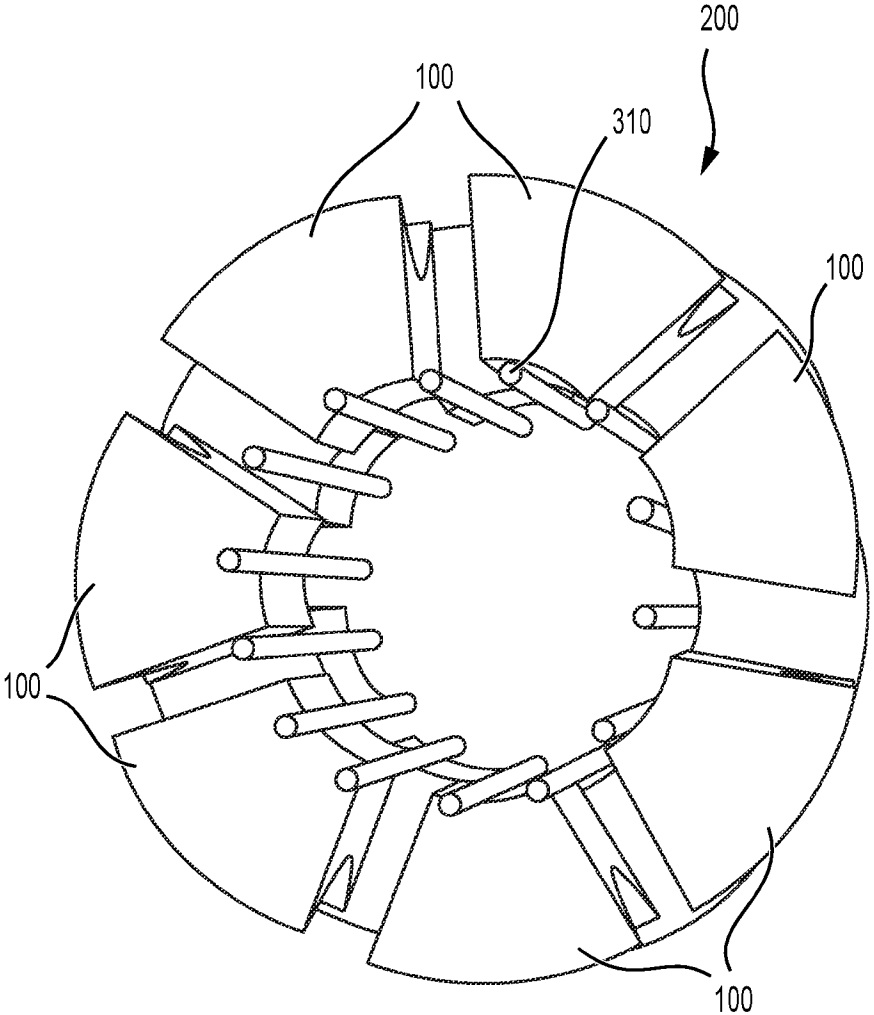
FIG. 3A is an example illustration of a top-down perspective view of a cutter in a radially expanded state.

FIGS. 3A and 3B are example illustrations of a top-down perspective view of a cutter in separate closed (FIG. 3B) and radially expanded (FIG. 3A) states. The cutter ring 200 can be lowered into a wellbore while in the closed state shown in FIG. 3B. When the cutting tool reaches a target wellbore depth, the cutter ring 200 can be expanded as shown in FIG. 3A. An opening mechanism can radially expand the cutter ring 200. This can allow for moving a compact cutting tool into place, where it is then expanded for operation. In this example, the opening mechanism includes multiple cylinders 310 or lines to press the charges outward from inside the ring. The charges 100 can be pressed against the inside diameter of a tubular to eliminate radial charge clearance and eliminate a high and low side for the cutting process.

Figure 4B:
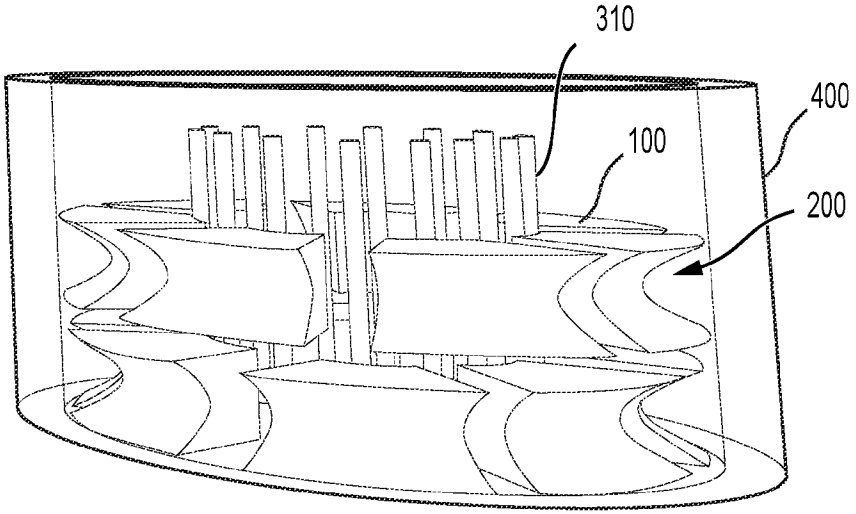
FIG. 4B is an example illustration of a side perspective view of a cutter in a radially expanded state.
Figure 4A:
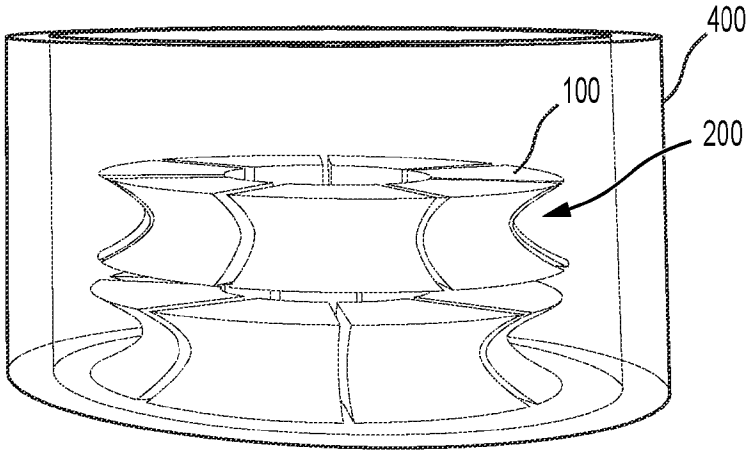
FIG. 4A is an example illustration of a side perspective view of a cutter in a closed state.

FIGS. 4A and 4B illustrate the dynamic nature of the cutter rings 200. In the closed state (FIG. 4A), a deliberate clearance space is present between the interior wall of a tubular structure 400 and the shaped charges 100. This intentional gap is strategically designed to facilitate the movement of the cutting tool into position, showcasing a thoughtful approach to operational flexibility.

In contrast, FIG. 4B shows the cutter ring 200 in a radially expanded state. In this configuration, the clearance space between the tubular 400 wall and the charges 100 is eliminated. By pressing the charges 100 against the tubular wall, this radial expansion ensures a tighter and more precise cutting action. The deliberate elimination of clearance space is aimed at reducing the risks of inadvertently damaging other portions of the wellbore during the cutting process, emphasizing the importance of precision and controlled execution in industrial applications.

When the charges 100 are deployed, a gap exists between consecutive charges at the same axial level. Additional layers of shaped charges 100 can be deployed offset from other layers to ensure a full 360 degree cut coverage while not making a continuous 360-degree single cut that would sever the tubing 400. Any desired number of layers of shaped charges 100 can be combined and can be offset vertically.

When the charges 100 are deployed, a deliberate gap exists between consecutive charges 100 at the same axial level (i.e., in the same cutter ring 200). This strategic spacing allows for precision in the cutting process and prevents the formation of a continuous 360-degree single cut that would sever the tubing 400.

To ensure comprehensive 360-degree cut coverage, additional layers of shaped charges 100 can be deployed, and these layers can be offset from each other. This offset deployment strategy ensures that the cutting action covers the entire circumference without compromising the integrity of the tubing 400. The flexibility mentioned in deploying any desired number of layers and vertically offsetting them underscores the adaptability of the system to different wellbore conditions and operational requirements. The approach described in this paragraph reflects a meticulous design aimed at achieving precise and controlled cutting outcomes in a wellbore environment.

Figure 5:
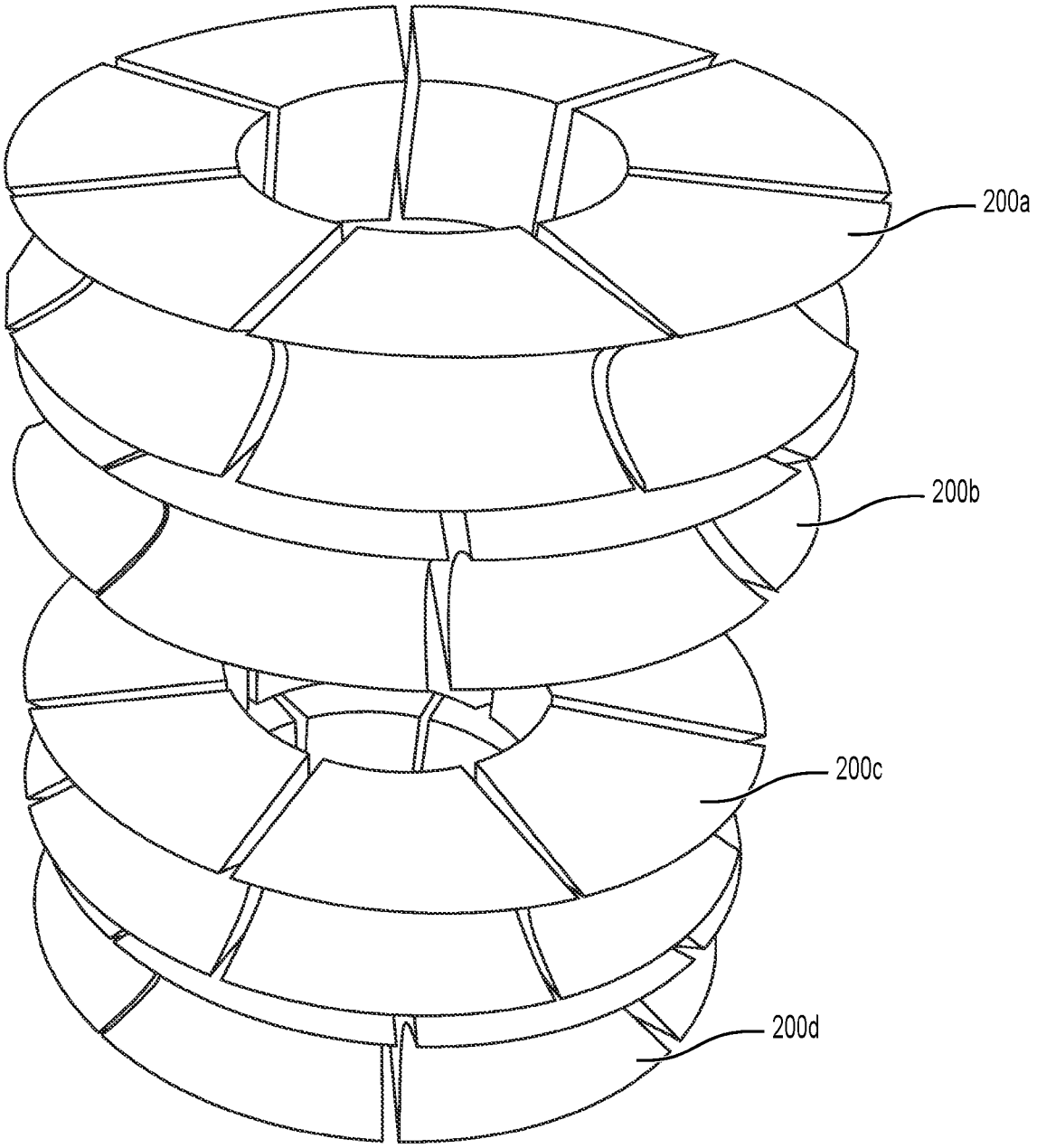
FIG. 5 is an example illustration of a cutter having multiple vertically stacked rings.

FIG. 5 is an example illustration of a cutter having multiple vertically stacked rings 200, shown as ring 200*a*, ring 200*b*, ring 200*c*, and ring 200*d*. The spacing can vary between the stacked rings 200*a-d*. Each ring 200 can be a separate cutting assembly. For example, one set can be two feet apart from a second set. And a third set can be one foot above the second set. The individual cutter assemblies can be fired separately by use of addressable switch technology or other selective mechanisms.

In FIG. 5, a comprehensive view of a cutter is presented, featuring a sophisticated design with multiple vertically stacked rings (labeled as 200*a*, 200*b*, 200*c*, and 200*d*). Each of these rings represents a discrete cutting assembly, highlighting a modular and layered approach to the cutting process. The spacing between the stacked rings (200*a-d*) is deliberately varied, introducing a dynamic element to the cutter's configuration.

For instance, one set of rings can be positioned two feet apart from a second set, and a third set can be located one foot above the second set. This tiered and spaced arrangement is likely designed to optimize the cutting process based on specific operational requirements or wellbore conditions.

Each ring can be independently activated. This selective firing is made possible through the use of addressable switch technology or other selective mechanisms. This allows for a high degree of control and precision in the execution of the cutting operation, enabling operators to tailor the cutting action to specific segments of the wellbore or to respond to varying conditions in a strategic and adaptable manner.

Figure 6:
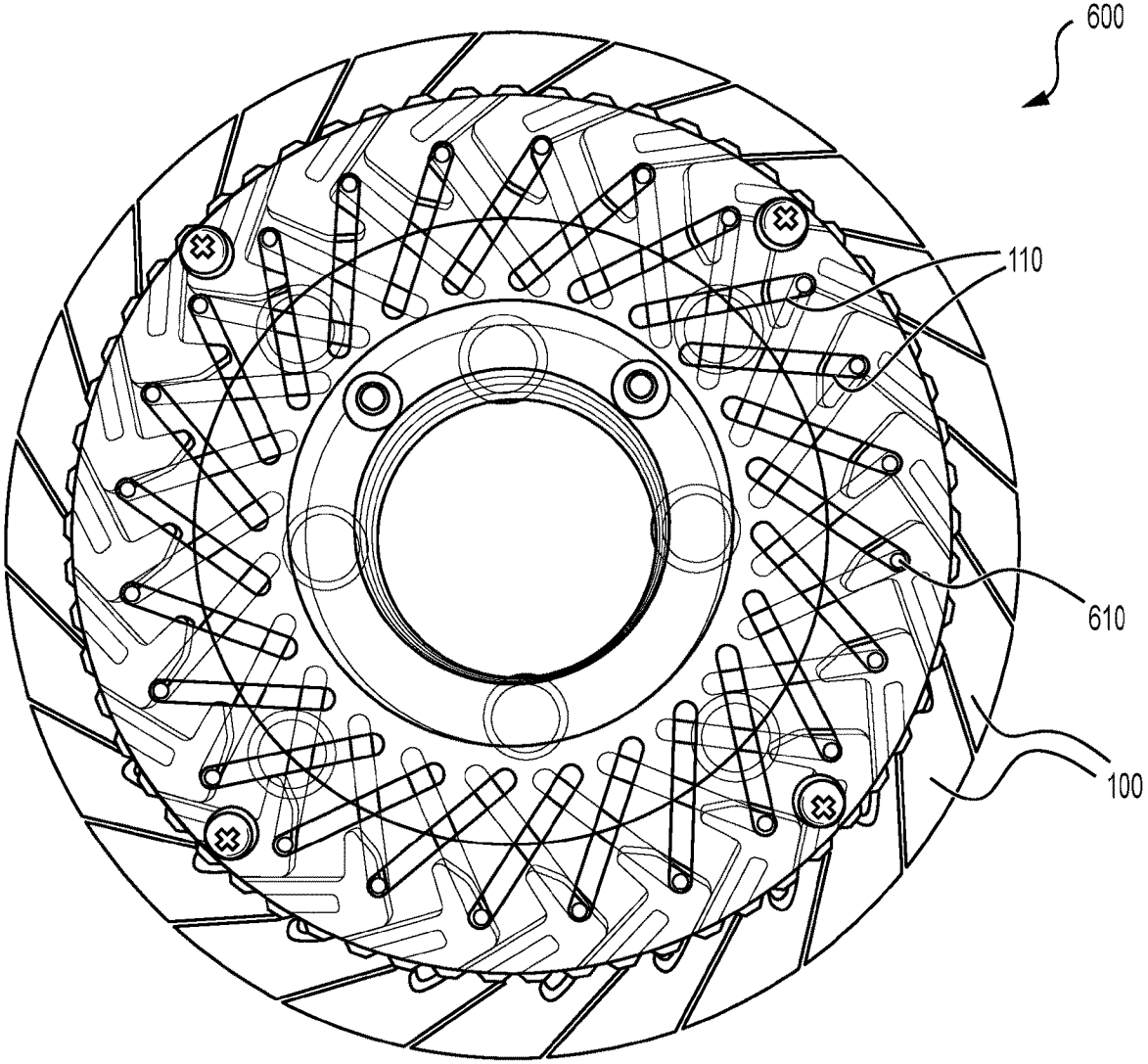
FIG. 6 is an example image of an opening mechanism.

FIG. 6 is an example illustration of an opening mechanism 600. Guidance pins 610 in the opening mechanism 600 pass through the guidance grooves 110 of the charges 100. The guidance pins 610 can be made of any rigid material.

The guidance grooves 110 are slanted from the center of the opening mechanism 600 so that the charges 100 rotate and expand outward away from each other as they expand. This creates separation between the charges 100 so that they do not sever the tubing upon detonation.

FIG. 6 depicts a detailed illustration of an opening mechanism 600. Within this mechanism 600, cylinders 610 play a crucial role, traversing through the guidance grooves 110 integrated into the charges 100. These cylinders 610, which can be crafted from a variety of rigid materials, facilitate the controlled movement of the charges. Notably, the guidance grooves 110 exhibit a slanted orientation emanating from the center of the opening mechanism 600. This deliberate slant induces a rotational motion in the charges 100 and promotes their outward expansion, creating a distinct separation between adjacent charges 100. The designed configuration ensures that, upon detonation, the charges 100 diverge away from each other, mitigating the risk of tubing severance and contributing to the overall safety and efficiency of the system.

Figure 7:
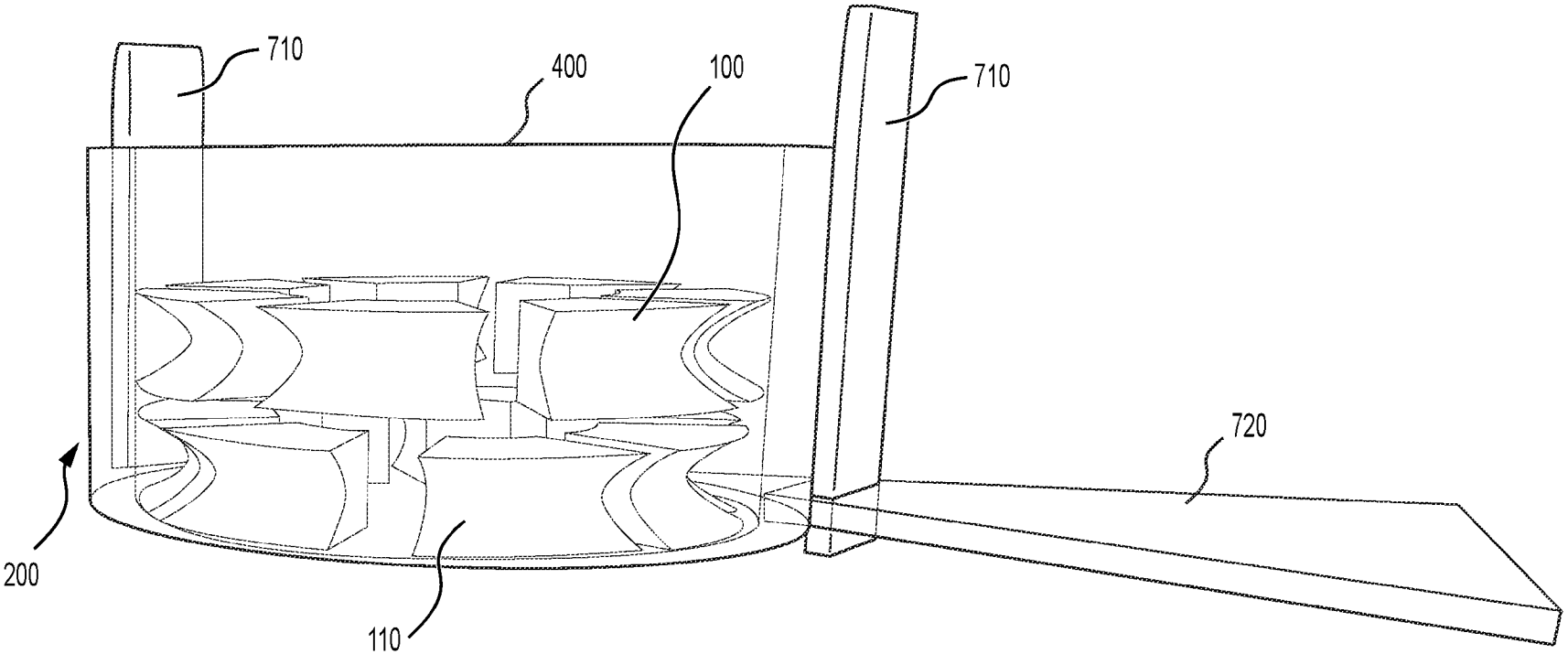
FIG. 7 is an example illustration of a perspective view of a cutter segment performing a jet cutting.

FIG. 7 presents a comprehensive perspective view, showcasing a cutter segment adept at executing precision cuts on an adjacent control line 710. The controlled explosion process is elucidated by an explosion profile 720, illustrating the systematic detonation of a single charge 100 as it traverses the control line 710. Various methods are employed to achieve this controlled cutting, offering flexibility and adaptability to diverse operational scenarios.

In one method, a selective approach is adopted wherein only specific shaped charges 100 are designated as live charges. This deliberate selection allows for meticulous jet cutting and other precision techniques. As an illustrative example, certain shaped charges 100 within the system can be configured as dummy charges, mimicking the same shape but devoid of detonating capabilities. This strategic configuration ensures that not all charges cut through the pipe in a continuous 360-degree fashion. Instead, the live shaped charges 100 can be precisely oriented towards the identified location of the control line(s) 710, either actively or passively, once the control line 710 outside the tubing 400 is pinpointed.

Alternatively, another method involves the selective detonation of charges 100. For instance, within a ring 200 of charges 100, a single charge 100 or a few chosen charges 100 can be selectively detonated. This selective activation mechanism provides a high degree of control over the cutting process, enabling tailored and targeted actions to enhance the overall efficiency and effectiveness of the system.

Figure 8:
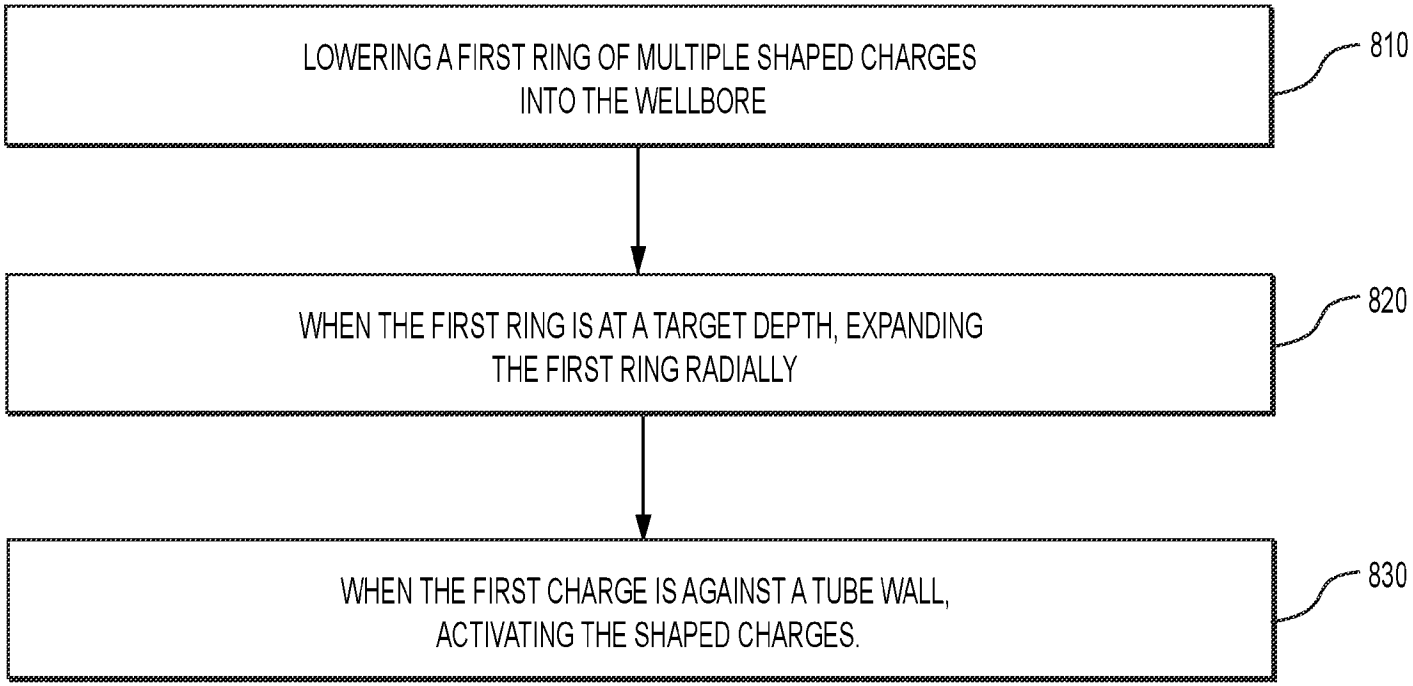
FIG. 8 is an example flowchart of a method for plugging and abandoning a wellbore.

In FIG. 8, an exemplary flowchart details a method designed for the plugging and abandonment of a wellbore. Commencing at stage 810, an operator initiates the process by lowering a cutting tool into a wellbore. This entails the gradual descent of a first ring 200 comprising multiple identically shaped and contiguous charges 100 into the wellbore. Simultaneously, a sensor array is engaged to meticulously monitor the depth of the cutting tool, ensuring precision in the subsequent steps.

Upon reaching a predefined target depth, such as the cutting location for a control line 710, stage 820 comes into play. At this juncture, the ring 200 dynamically expands radially, causing the charges to exert controlled pressure against the interior tubular wall 400. The system is now poised for the activation of charges at stage 830, marking the initiation of the plugging and abandonment process.

Several embodiments of the invention incorporate a roller assembly to enhance the orientation of the perforating gun, providing a versatile and efficient means for wellbore operations. This innovative feature allows for precise control over the positioning of the perforating gun, affording operators greater flexibility in executing complex maneuvers within the wellbore environment.

For instance, an operator is empowered to command and manipulate the roller assembly, guiding the perforating gun into the desired position with ease. The roller assembly's adaptability enables the operator to effect both longitudinal and rotational movements of the perforating gun, allowing for meticulous alignment along its central axis. This level of control is particularly valuable in scenarios where the wellbore's geometry or specific operational requirements demand intricate adjustments.

The utilization of a roller assembly not only streamlines the deployment process but also ensures that the perforating gun can be precisely maneuvered into strategic positions within the wellbore. The operator's ability to navigate both longitudinally and rotationally enhances the overall accuracy of wellbore operations, aligning with the industry's ongoing commitment to advancing technologies that optimize efficiency and safety in oil and gas exploration and production.

Other embodiments of the invention will be apparent to those skilled in the art from consideration of the specification and practice of the invention disclosed herein. It is understood that the control functionality can be carried out by a processor-enabled device, which can be separate from or part of the slot cutter, depending on the example. Also, the terms slot cutter and cutting device are used interchangeably. It is intended that the specification and examples be considered as exemplary only, with a true scope and spirit of the invention being indicated by the following claims.

What is claimed is:

1. A segmented radial cutter gun positionable within a downhole tubular, the segmented radial cutter gun comprising:

a first ring of multiple shaped charges, wherein a first charge and a second charge in the first ring are identically shaped and contiguous, wherein the first ring is configured to expand radially to deploy the shaped charges against an inner surface of the downhole tubular, wherein the first and second charges each include a guidance groove that accepts a guidance pin, and wherein, with the guidance pin engaged, the first and second charges are configured to transition radially outward when plates above and below the first and second charges are rotated with respect to each other.

2. The segmented radial cutter gun of claim 1, wherein, in a nonexpanded state, the first ring is configured to be lowered into the downhole tubular in a wellbore.

3. The segmented radial cutter gun of claim 1, wherein the radially expanded first ring includes a gap between the first and second charges.

4. The segmented radial cutter gun of claim 1, wherein the first charge is a dummy charge and the second charge is a live charge.

5. The segmented radial cutter gun of claim 1, further comprising:

a second ring of multiple shaped charges, wherein the second ring is positioned on a different axial level with respect to the first ring, and wherein first gaps between the multiple charges of the first ring are rotationally offset from second gaps between the multiple shaped charges of the second ring.

6. The segmented radial cutter gun of claim 5, wherein deploying the charges of the first and second rings results in a full 360 degree cut coverage across two different axially levels, and wherein there is not a continuous 360 degree cut on either of the two different axial levels.

7. The segmented radial cutter gun of claim 5, wherein the second ring is offset vertically from the first ring by more than one foot.

8. The segmented radial cutter gun of claim 5, wherein the first and second rings are configured to be fired separately.

9. The segmented radial cutter gun of claim 8, further comprising an addressable switch to fire the first and second rings separately.

10. The segmented radial cutter gun of claim 5, further comprising:

third and fourth rings of multiple shaped charges, the third and fourth rings being axially offset from the first and second rings.

11. The segmented radial cutter gun of claim 1, wherein the charges in the first ring other than the second charge are dummy charges, and wherein the second charge is positioned relative to a control line.

12. A method for plugging and abandoning a wellbore, comprising:

lowering the segmented radial cutter gun of claim 1 into the wellbore;

when the first ring is at a target depth, expanding the first ring radially; and when the first charge is against the inner surface of a downhole tubular of the wellbore, activating the shaped charges.

13. The method of claim 12, wherein the first ring is lowered in a nonexpanded state.

14. The method of claim 12, wherein the radially expanded first ring includes a gap between the first and second charges.

15. The method of claim 12, wherein the first charge is a dummy charge and the second charge is a live charge, and wherein the second charge is positioned relative to a control line.

16. The method of claim 12, wherein a second ring of multiple shaped charges is positioned on a different axial level with respect to the first ring, and wherein first gaps between the multiple shaped charges of the first ring are rotationally offset from second gaps between the multiple shaped charges of the second ring, the method further comprising positioning the first and second rings based on their respective first and second gaps.

17. The method of claim 16, further comprising firing the first and second rings separately.

18. The method of claim 17, wherein an addressable switch fires the first and second rings separately.

* * * * *